US005921006A

United States Patent [19]

Vargas, III

[11] Patent Number: 5,921,006

[45] Date of Patent: Jul. 13, 1999

[54] FLEXIBLE SKI BOOT

[76] Inventor: Joseph H. Vargas, III, Woodstock Ave., RR3, Box 7118, Rutland, Vt. 05701

[21] Appl. No.: 09/002,498

[22] Filed: Jan. 2, 1998

[51] Int. Cl.[6] ..... A43B 5/04

[52] U.S. Cl. ..... 36/118.2; 36/118.3

[58] Field of Search ..... 36/117.1, 118.2, 36/118.3, 118.4, 119.1

[56] References Cited

U.S. PATENT DOCUMENTS

| | | | |
|---|---|---|---|
| 4,447,970 | 5/1984 | Delery | 36/118.3 |
| 5,410,822 | 5/1995 | Vaccari | 36/117.1 |
| 5,519,951 | 5/1996 | Paris | 36/117.1 |
| 5,740,620 | 4/1998 | Giese et al. | 36/118.2 |
| 5,746,016 | 5/1998 | Freisinger et al. | 36/117.1 |

FOREIGN PATENT DOCUMENTS

| | | | |
|---|---|---|---|
| 132706 | 2/1985 | European Pat. Off. | 36/118.3 |
| 468170 | 1/1992 | European Pat. Off. | 36/118.3 |
| 479123 | 4/1992 | European Pat. Off. | 36/118.2 |

*Primary Examiner*—M. D. Patterson
*Attorney, Agent, or Firm*—Kevin Ellicott, Esq.

[57] ABSTRACT

The invention disclosed is flexible ski boot having a rigid shell base, a cuff section attached to the rigid shell base, a tongue section flexibly connected to the cuff section and pivotably attached to both cuff section and the rigid shell base, a spoiler section pivotally attached to the rigid shell base, and temporarily attached to tongue section by ski boot bindings. The flexible ski boot further has two somewhat compressible pieces held within the spoiler section by a retainer and a bolt passing through the retainer, the compressible piece and into the rigid shell base, the compressible pieces tending to maintain the upper section of the ski boot in its upright position when force is rearwardly applied against the upper section.

4 Claims, 5 Drawing Sheets

FLEXIBLE SKI BOOT

FEDERALLY SPONSORED RESEARCH AND DEVELOPMENT

There are no federally sponsored or funded research or development projects or undertakings in any way associated with the instant invention.

CROSS REFERENCE TO OTHER APPLICATIONS

This is the first submission of an application for this article of manufacture. There are no other applications, provisional or non provisional.

BACKGROUND OF THE INVENTION

1. Field of the Invention

The instant invention relates to that field of devices consisting of articles of manufacture known as ski boots. Specifically, the instant invention is a ski boot having a pair of pivoting axis and a flexibly attached upper and lower tongue section.

2. Background Information

The prior art known to applicant discloses that ski boots are well known. These boots have been manufactured for many years, and have changed over the years in an ongoing effort to minimize skiing related injuries.

In the past, skis were connected to boots via a number of different connection devices. The early models of ski boots were low cut, ending at or below the wearer's ankle.

Unfortunately, the various forces which are exerted upon a skier's legs during the act of skiing often led to serious injuries. Most common among these injuries were broken ankles and broken leg bones between the knees and ankles. This problem was alleviated to some extent by the widespread use of releasable bindings which releasably held the ski boot to the ski. When a skier encountered a strong impact (for example, by hitting a bump or "mogul") while skiing, or applied excessive forward or rearward force to the binding (for example, during a fall or near fall), the tension exerted by the releasable binding would be overcome, and the ski would be released. Hopefully, the ski released before serious injury occurred.

However, even with releasable bindings, leg injuries continued to plague skiers. In an effort to minimize these injuries, ski boot manufacturers created boots which extended farther up the leg, holding the ankle steady during skiing. This innovation did not come without a price. These new boots tended to relocate the brunt of the forces encountered by the skier up the leg, to the knees. Instead of injuries being primarily located at the ankle, injuries which occurred while wearing these new boots began to appear more frequently at the knees, and at the bones between the knees and the tops of the boots. Approximately 600,000 skiers are injured annually in the United States. Since 1972, injuries to the knee ligaments have increased by about 300%. Among these types of injuries, perhaps the most common has become tears to the anterior cruciate ligament. Of all ski related knee injuries, approximately 60% are of this type.

Furthermore, the skier's themselves often contributed to worsening this problem by tightening the releasable bindings beyond a safe release limit. In an effort to maintain still greater control while skiing, the skiers often tightened the bindings which retain the boot on the foot, to an uncomfortable and dangerous tightness.

SUMMARY OF THE INVENTION

The instant invention is safety ski boot which tends to reduce the stresses encountered during skiing, while at the same time maintaining ankle support. This is accomplished by the incorporation of two pivot axis, a biasing means, and a flexible joint. The biasing means prevents any change in the interior diameter of the upper section of the boot while still permitting that upper section of the boot to flex forwardly and rearwardly relative to the lower section of the boot. The flexible joint permits the boot to flex along the front of the boot, in addition to the motion permitted by the two pivot axis.

The biasing means is attached through the utilization of a set of fasteners which pass through both the upper section of the boot and through the rigid shell base, connecting the upper section of the boot to the rigid shell base and which have mounted upon them the biasing means. A first biasing means fastener passes through the right side of the boot, above the ankle, and a second biasing means fastener passes through the left side of the boot, above the ankle. The biasing means fasteners help to maintain in position the biasing means. By creating a resilient biasing connection between the upper sections of the boot, and the lower section of the boot, Applicant's invention eliminates the possibility of upper boot section interior diameter changes while permitting the upper boot section to flex forwardly and rearwardly.

The biasing means permits the upper section of the boot to flex rearwardly (away from the toe section of the boot) when sufficient pressure is applied against the upper section of the boot, while at the same time tending to maintain the boot in its original position.

A pair of pivotal fasteners form the first pivot axis. These pivotal fasteners, referred to as tongue and cuff pivot fastening means, are locatable on the lower section of the boot, below the ankle, and disposed more toward the toes. The tongue and cuff pivot fastening means pass through the tongue section, the cuff section and the rigid shell base, and are used as a pivot point. When constructed into the ski boot, the first pivot axis permits the tongue of the boot to pivot forwardly and rearwardly relative to the lower section of the boot.

A third pivotal fastener forms the second pivot axis. This fastener, referred to as a spoiler pivot fastening means is locatable in the heel section of the boot, passing through the spoiler and rigid shell base of the boot. The second pivot axis permits the spoiler to pivot relative to the lower section of the boot.

Finally, a flexure joint comprising a connection between the upper section of the boot and the portion of the boot directly overlying the dorsal section of the foot, on what is often called the tongue of the boot further permits the upper section of the boot to flex forwardly and rearwardly relative to the lower section of the boot (the rigid shell base). The flexible joint is constructed so as to prevent the intrusion of material such as snow and slush into the interior of the boot. A forward stop is incorporated upon both the tongue of the boot and the cuff of the boot, helping to prevent the upper section of the boot from flexing too far toward the area of the boot which the skier's toes will occupy.

It should be clear at this point that the instant invention differs significantly from the prior art ski boots. In the prior art, ski boots were rigid, and tended to transfer whatever forces were encountered by the ski, to the skier's legs. By adding a flexible joint, a number of pivotal connectors, and by utilizing resilient biasing means, Applicant's ski boots can actually absorb some of those forces previously transferred directly to a skier's legs. Applicant believes that by absorbing some of the most jarring impacts to the skier's legs, and by permitting the legs to flex rearwardly when a certain resistance point is passed, the instant invention should dramatically reduce ski related injuries to the knees and legs. Applicant also believes that by configuring a ski boot in a manner which permits the upper section of the boot to flex relative to the bottom section of the boot, while at the same time maintaining the inner diameter of the upper section of the boot, skier's will be far less likely to over or under adjust the bindings of the boot in order to obtain the level of control they desire. This, in turn, will further reduce the number of injuries which occur as a result of improper adjustment of bindings.

Furthermore, the instant invention directly addresses some of the most common causes of a tear to the anterior cruciate ligament. In this sort of injury, a common set of six actions on a skier's part have been noted. First, during a ski run, the skier may become off balance, with his or her balance shifted to the rear. Second, the skier's hips become oriented at a point below his or her bent knees. Third, the skier's uphill arm is moved back, away from the tip of the skis. Fourth, the weight of the skier is moved off the uphill ski. Fifth, the weight of the skier becomes located on the inside edge of the downhill ski tail. Sixth, the skier's upper body becomes oriented so that it is basically facing the downhill ski. When in this position, the stresses placed upon the anterior cruciate ligament are so great that the ligament may tear free of the bone, resulting in a terrible injury.

Applicant believes that the instant invention will reduce this sort of stress by allowing the skier's lower leg to bend backward somewhat, relative to the skis, thereby relieving a portion of the stress which is placed upon the cruciate ligament. However, while the instant invention reduces the stresses placed upon a skier's knee, the boot remains relatively unflexed during normal skiing, so that the skier will not perceive any accompanying loss of control.

Additionally, Applicant's invention makes it possible to vary the resistance which must be overcome before the upper section of the boot flexes rearwardly by simply removing one set of biasing means and inserting another having a different compressibility profile. This permits custom configuring of the boots based upon the wearer's physical requirements (such as height and weight of the wearer) and the wearer's personal preferences (more or less force required to cause the boot to flex). No other prior art ski boots known to Applicant, allow this sort of versatility.

Finally, Applicant believes that these boots can be manufactured using current industry tools and dies, eliminating the need for extensive retooling. In the instant invention, the biasing means is located at the place currently occupied by the adjustable stop wherein the spoiler and the tongue overlap, said adjustable stop in the prior art being used to control somewhat the inner diameter of the upper section of the boot. The first pivot axis, in turn, is locatable in close proximity to the stud currently used to retain the lower section of the cuff to the rigid shell base. Furthermore, the second pivot axis is locatable at the place currently occupied by the stud which retains the spoiler to the rigid shell the boot. The closure means found on most boots today may be left unaltered, further simplifying production of the instant invention.

It should be understood that as in the prior art, the spoiler and what is generally referred to as the cuff, are retained together and against the skier's legs through the utilization of ski boot closure means, and that as in the prior art, a sort pliable interior padded section is slipped inside the boot. The pliable interior padded section is not shown in the instant invention as it contributes nothing new.

A DESCRIPTION OF THE DRAWINGS

A DESCRIPTION OF THE PREFERRED EMBODIMENT

Figure 1:
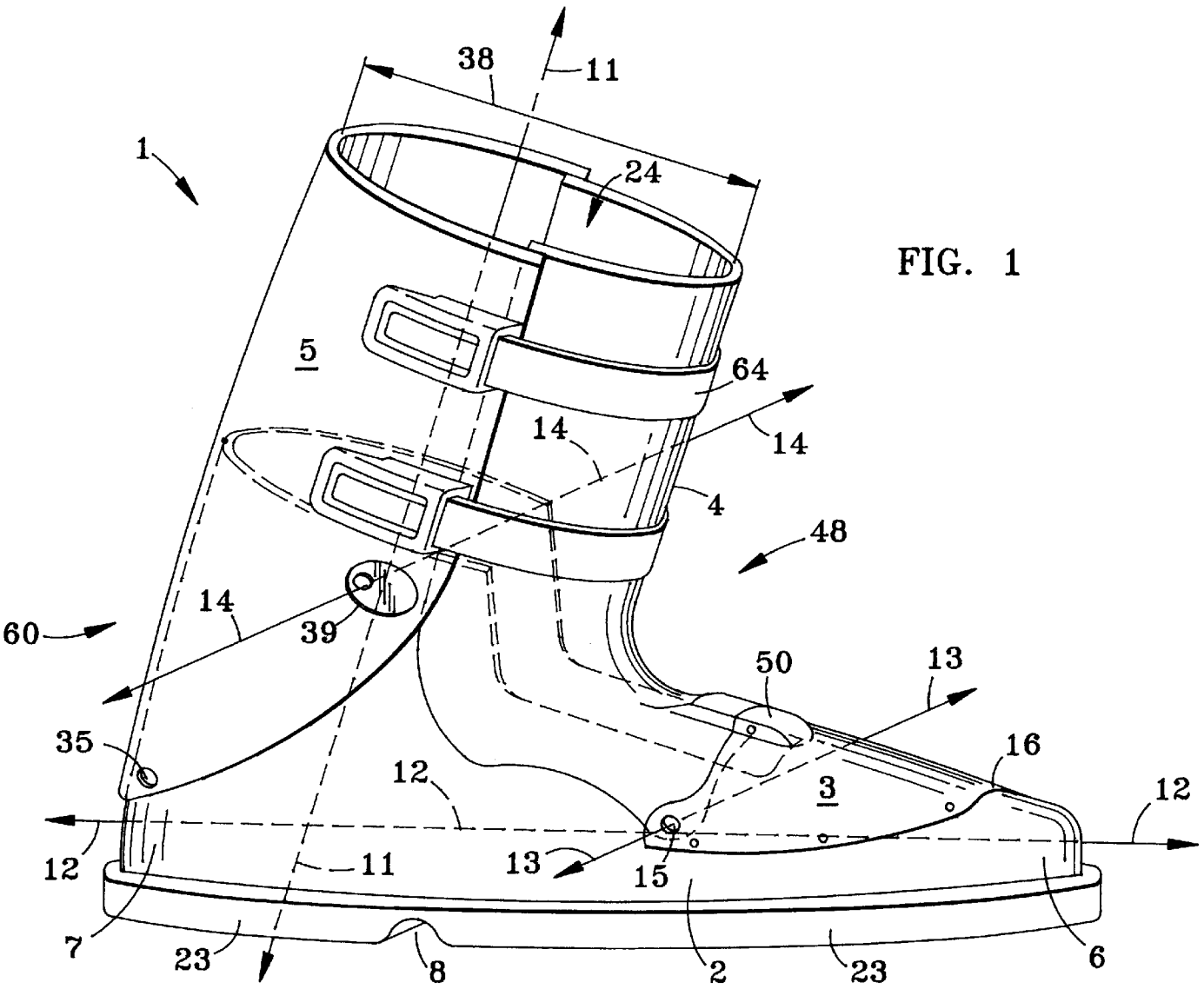
FIG. 1 is a perspective view of the assembled flexible ski boot.
Figure 2:
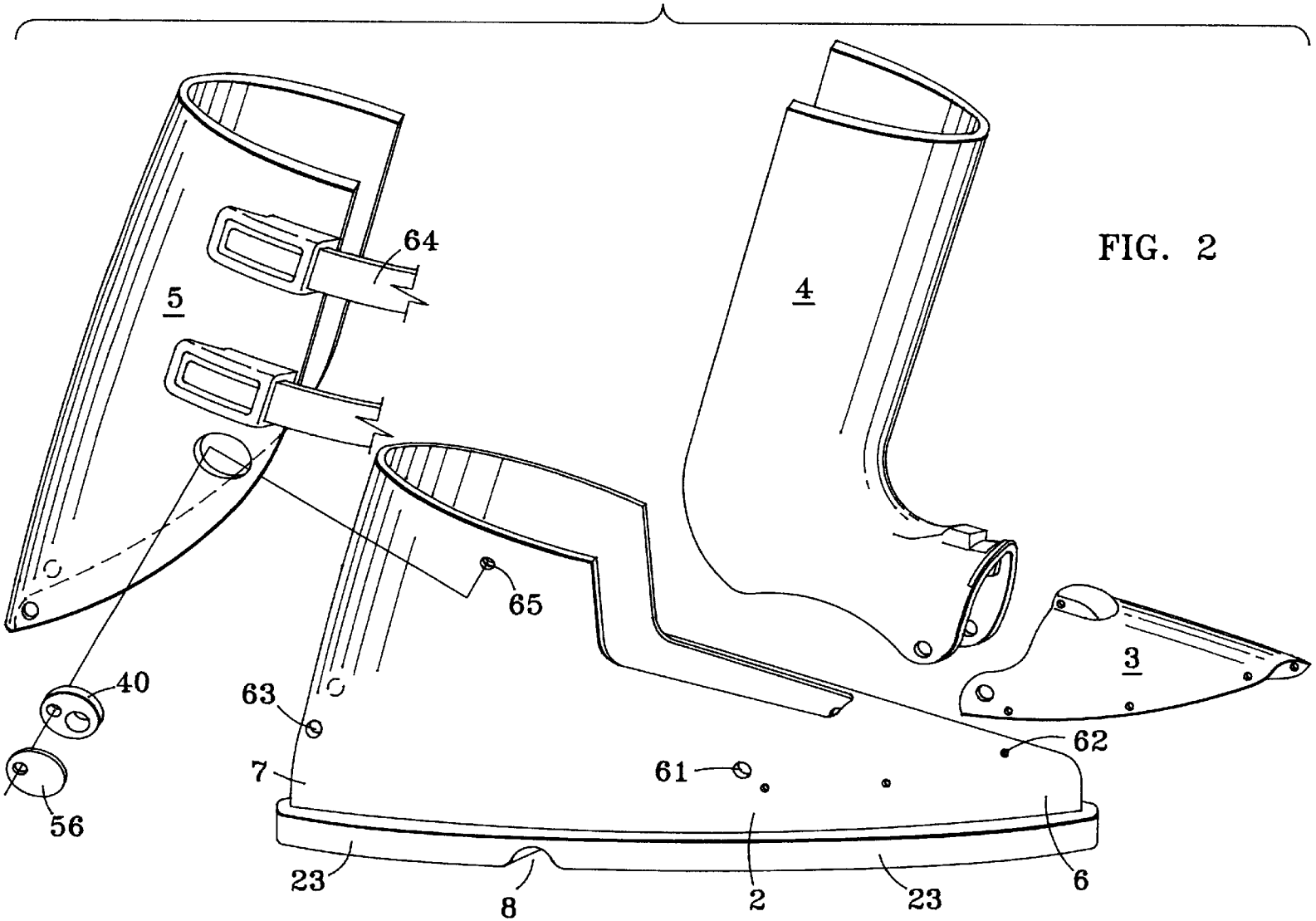
FIG. 2 is a perspective view of the flexible ski boot rigid shell base, cuff section, tongue section, spoiler section, biasing means and biasing means retainer.

As per FIGS. 1 and 2, a ski boot (1) of the type commonly referred to as a "rigid shell" type is constructed having a rigid shell base (2) having a sole (23), the rigid shell base supporting a cuff section (3) a tongue section (4) and a rear spoiler (5). While the prior art such as Perrissoud, U.S. Pat. No. 5,392,536 have incorporated a one piece cuff section, Applicant's invention utilizes a two piece cuff. In the instant invention, the cuff section (3) corresponds to the lower area of the prior art cuff while the tongue section (4) corresponds to the upper area of the prior art cuff. For purposes of understanding, "lower" should be taken to mean closer to the rigid shell base sole (23), while upper should be taken to mean closer to a boot opening (24).

As per FIGS. 1 and 2, the rigid shell base (2) may be described as having a rigid shell base front (6), a rigid shell base rear (7) and a rigid shell base middle (8). When worn by a skier the skier's foot will enter the ski boot through the boot opening (24) and occupy a hollow interior of the ski boot. The rigid shell base front (6) will contain the toes of the skier's foot, the rigid shell base rear (7) will contain the heel of the skier's foot and the rigid shell base middle (8) will lie in that section of the ski boot which will underlie and be in close proximity to the arch of the skier's foot. It should be understood that the ski boot has ski boot right side (60) and an opposite ski boot left side (48). It should be further understood that while only one boot is described, a pair of such boots will be needed by the skier, the boots being mirror images of one another.

As per FIG. 1, in furtherance of understanding the instant invention, it is useful to describe a first horizontal axis (12)

as passing through the rigid shell base rear (7), the rigid shell base middle (8) and the rigid shell base front (6). A second horizontal axis (13) may be described as being coplanar with, and perpendicular to, the first horizontal axis (12), the second horizontal axis passing through the cuff section (3), the rigid shell base (2) and the tongue section (4). A third horizontal axis (14) may be described as parallel to the second horizontal axis (13), the third horizontal axis passing through the rear spoiler (5), the rigid shell base (2) and the tongue section (4). A first vertical axis (11) may be described as being nearly perpendicular to the first horizontal axis (12) and the second horizontal axis (13).

Figure 3:
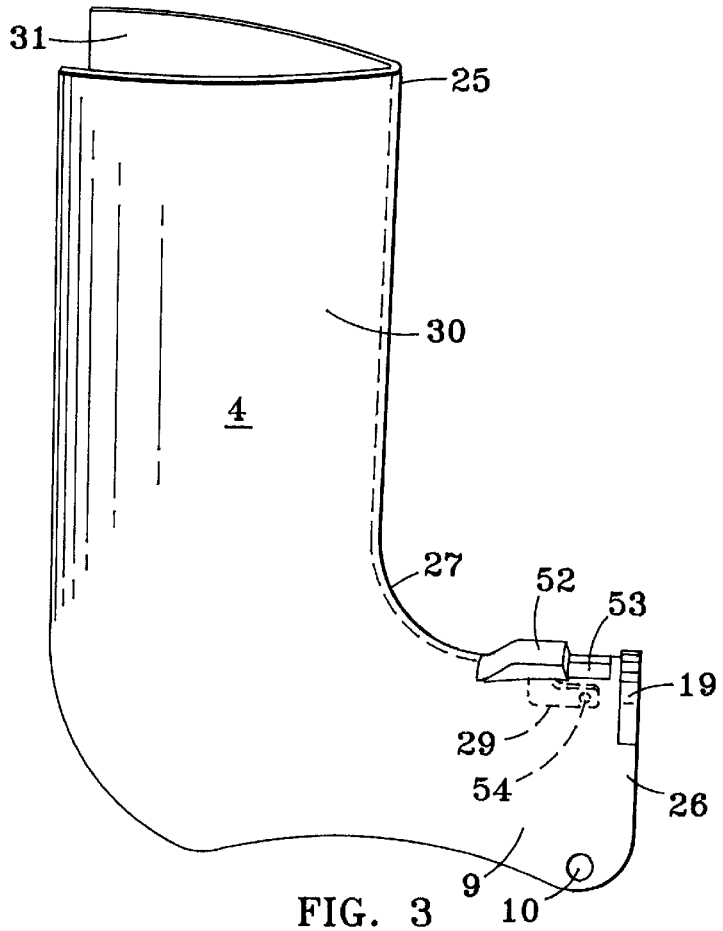
FIG. 3 is a perspective view of the flexible ski boot tongue.

As per FIGS. 1 and 3, the cuff section (3) is fixedly attached to the rigid shell base (2). The cuff section has a cuff front (16), a cuff rear (17) a cuff ventral surface (20), and a cuff dorsal surface (21). Once assembled onto the rigid shell base (2), the cuff ventral surface (20) will be in direct contact with the rigid shall base, the cuff front (16) will be locatable proximate to the area of the ski boot which will be occupied by the skier's toes, while the cuff rear (17) will be in contact with the tongue section (4). In the preferred embodiment, this fixed attachment is accomplished by screws passing through cuff screw holes (49) locatable on the cuff section and into holes locatable on the rigid shell base (62). However, any means for fixedly attaching the cuff section to the rigid shell base would do equally well.

Figure 4:
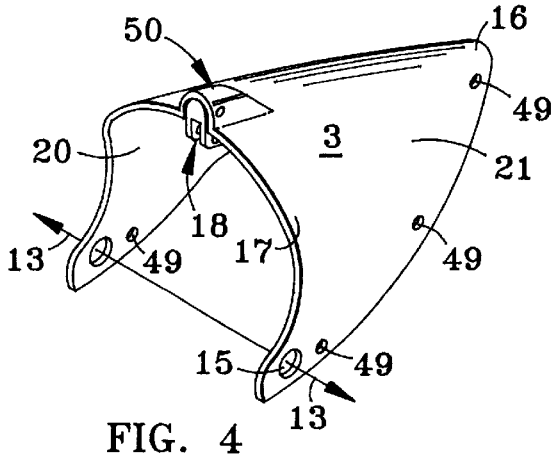
FIG. 4 is a perspective view of the flexible ski boot cuff.
Figure 7:
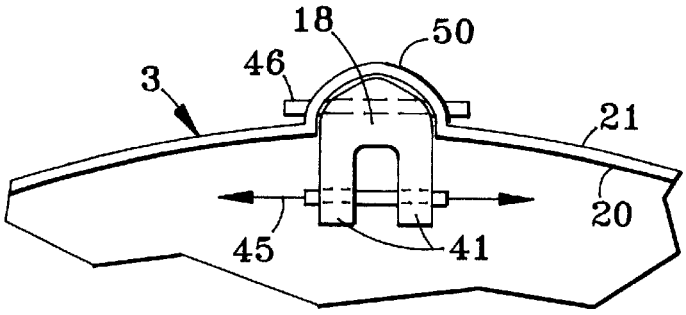
FIG. 7 is a close up rear view of a portion of the flexible ski boot cuff.
Figure 9:
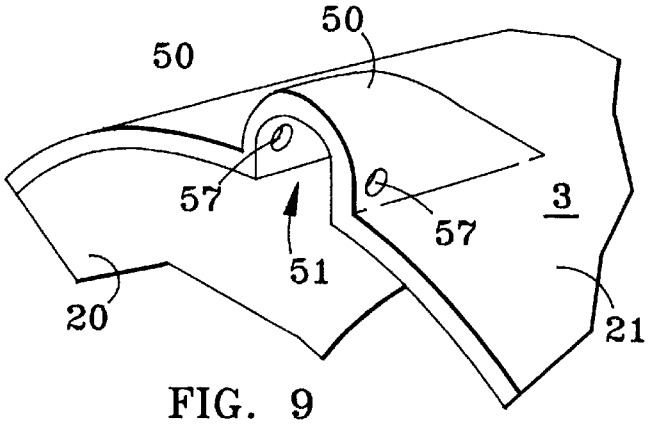
FIG. 9 is a rear perspective view of the flexible ski boot cuff.

As per FIGS. 4, 7 and 9, in the preferred embodiment, the cuff section (3) has incorporated thereon a cuff section stop (50). The cuff section stop is a raised area of the cuff section, the cuff stop having a cuff stop hollow cavity (51) locatable on the ventral side of the cuff section. The cuff stop further has a cuff stop hole (57) passing completely therethrough, the cuff stop hole being parallel to the second horizontal axis (13).

The cuff section (3) has a pair of oppositely aligned cuff holes (15) passing therethrough. The cuff holes pass completely through the cuff section (3), coaxially with the second horizontal axis (13).

As per FIGS. 4, 7, 8 and 9, when assembled into a ski boot, a cuff flexure yoke (18) is locatable within the cuff stop hollow cavity (51) . As per FIGS. 5, 6 and 7, in the preferred embodiment, the cuff flexure yoke is a body having depending downwardly therefrom a pair of cuff flexure yoke lobes (41). Each cuff flexure yoke lobe has passing completely therethrough a cuff flexure lobe hole (42). For understanding's purpose, a cuff flexure yoke second pivot axis (45) is locatable as passing through both cuff flexure lobe holes, said cuff flexure yoke second pivot axis (45) being parallel to the second horizontal axis (13). Furthermore, the cuff flexure yoke (18) has a cuff flexure yoke body hole (43). The cuff flexure yoke body hole passes completely through the cuff flexure yoke body, parallel to the cuff flexure yoke second pivot axis (45).

Figure 5:
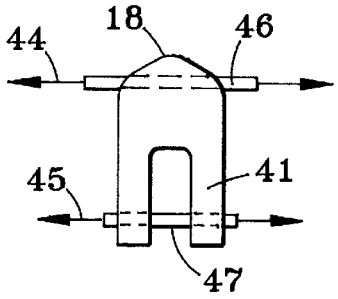
FIG. 5 is a front view of the flexible ski boot cuff flexure yoke.
Figure 6:
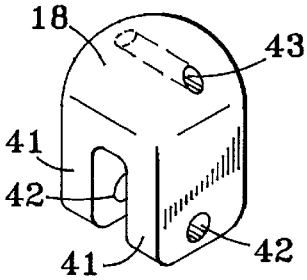
FIG. 6 is a perspective view of the flexible ski boot cuff flexure yoke.

In the preferred embodiment, as per FIGS. 5 and 6, it may be further understood that a cuff flexure yoke first pivot axis (44) may be described as passing through and coaxial with the cuff flexure yoke body hole (43), parallel to the cuff flexure yoke second pivot axis (45).

As per FIGS. 4, 5, 6, 7, and 9, the cuff flexure yoke (18) is attached within the cuff stop hollow cavity (51). In the preferred embodiment, a cylindrical cuff pin (46) is sized to snugly pass through the cuff stop hole (57) and the cuff flexure yoke body hole (43), thereby pivotally attaching the cuff flexure yoke (18) to the cuff (3). This permits the cuff flexure yoke to pivot relative to the cuff, the cuff flexure yoke pivoting within the cuff stop hollow cavity (51), on the cuff flexure yoke first pivot axis (44) and parallel to the first horizontal axis (12).

As per FIG. 3, the tongue section (4) has a tongue section upper end (25) a tongue section lower end (26), a tongue section mid-body (27), a tongue section dorsal surface (30) and a tongue section ventral surface (31). As in the prior art, the tongue section is shaped to fit against the shin of the skier. When assembled into the ski boot, the tongue section upper end will form a portion of the boot opening (24), while the tongue section lower end (26) will be in contact with the cuff rear (17). The tongue section ventral surface (31) will overlie the skier's shin.

As per FIG. 3, the tongue section has a tongue stop (52) locatable on the dorsal surface (30) of the tongue section (4), proximate to the most forward edge of the tongue section lower end (26). The tongue stop is a raised area of the tongue section. When fully assembled into the ski boot, the tongue stop and the cuff stop are in contact with one another. This ensures that the upper section of the boot cannot flex too far forwardly, further reducing the chances of ankle injury occurring.

Figure 10:
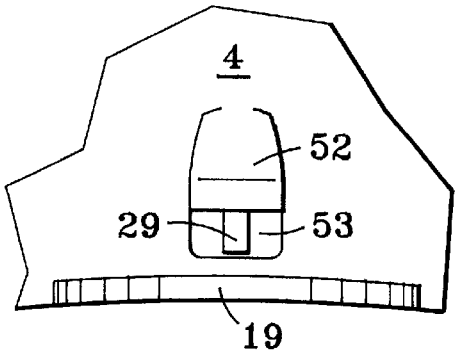
FIG. 10 is a overhead view of the front portion and most forward edge of the flexible ski boot tongue.

As per FIGS. 3 and 10, the tongue section has a tongue section slot (53) locatable on the tongue section dorsal surface between the tongue stop and the most forward edge of the tongue section lower end (26). The tongue section slot (53) passes completely through the tongue section dorsal side (30) and the tongue section ventral side (31). The tongue section slot (53) is sized and shaped to accommodate passage therethrough of the cuff flexure yoke (18).

Figure 8:
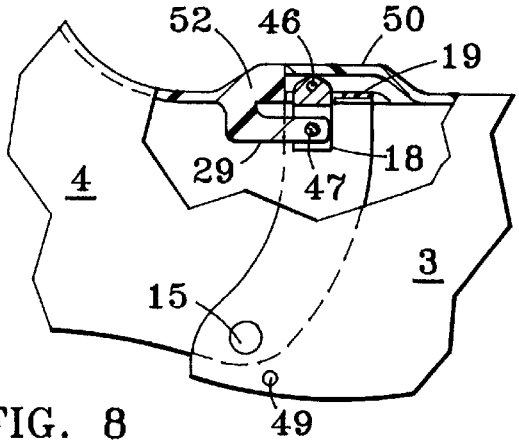
FIG. 8 is a partially cut away side view of the flexible ski boot cuff and tongue.

In the preferred embodiment, as per FIGS. 3, 8 and 10, the tongue section has a tongue section pivot tang (29) locatable on the ventral side (31) of the tongue section (4), approximately under the tongue stop (52). The tongue section pivot tang (29) has a tongue section pivot tang hole (54) passing completely therethrough. When assembled into the completed boot, the tongue section pivot tang hole (54) is coaxial with the cuff flexure yoke second pivot axis (45), the tongue section pivot tang extending sufficiently forward such that the tongue section pivot tang hole lies directly beneath the tongue section slot (53). Furthermore, the tongue section pivot tang (29) and the cuff flexure yoke (18) are sized and shaped as to be snugly pivotally interlocking with each other when the ski boot is assembled.

As per FIGS. 3, 7 and 8, when assembled, the cuff flexure yoke passes through the tongue section slot (53), and is pivotally attached to the pivot tang (29) utilizing a cylindrical tang pin (47). When assembled, the tongue section pivot tang (29) and the cuff flexure yoke (18) further permit the tongue section (4) and the cuff section (3) to flex relative to one another. Furthermore, in the preferred embodiment a cuff sealing means (19) is locatable between the tongue section slot (53) and the most forward edge of the tongue section lower end (26). When assembled into a completed ski boot, the cuff sealing means is in direct contact with both the tongue section (4) and the cuff section (3). A somewhat compressible and flexible material is utilized which will tend to compress and decompress when pressure is applied to it or removed from it during the flexing of the tongue section relative to the cuff section, thereby maintaining a firm seal between the cuff section and the tongue section. This firm seal prevents the intrusion into the boot by unwanted materials such as snow and slush.

While the flexure area of the instant invention has been described as involving a cuff flexure yoke and a pivot tang, Applicant believes that any means which will permit flexure of the tongue relative to the cuff would work equally well.

For example, one could flexibly attach the tongue section to the cuff section utilizing a flexible material such as a rubber strip, the rubber strip being attached to most forward edge of the tongue section lower end (26) and attached to the most rearward edge of the cuff rear (17). When configured in this fashion, the tongue section may flex rearwardly relative to the cuff section and a tight seal is maintained between the cuff section and the tongue section such that unwanted materials are kept from the interior of the boot. Furthermore, when configured in this manner, it is unnecessary to include a tongue section slot. However, it would still be necessary to include a tongue stop and a cuff stop in order to prevent excessive forward flexure.

As per FIGS. 1 2, and 3, in the preferred embodiment the tongue section (4) has depending therefrom a pair of tongue section lobes (9). The tongue section lobes (9) each have a tongue section lobe hole (10) passing therethrough. The tongue section lobe hole (10) passes completely through the tongue section lobe, coaxially with the second horizontal axis (13). When assembled into the ski boot, the tongue section lobe holes (10) align with and underlay the cuff holes (15) and align with and overlay a set of holes (61) in the rigid shell base. A tongue and cuff pivot fastening means is then passed through the cuff hole (15), the tongue section lobe hole (10) and the hole on the rigid shell base (61), on both the right and left sides of the boot, thereby forming the first pivot axis. The tongue and cuff pivot fastening means further attaches the cuff section (3) to the tongue section (4) as well as attaching the cuff section and the tongue section to the rigid shell base (2). In the preferred embodiment, the pivot fastening means is a pivot pin, although any fastener which permitted the cuff section and the tongue section to pivot relative to one another would do equally well.

Figure 13:
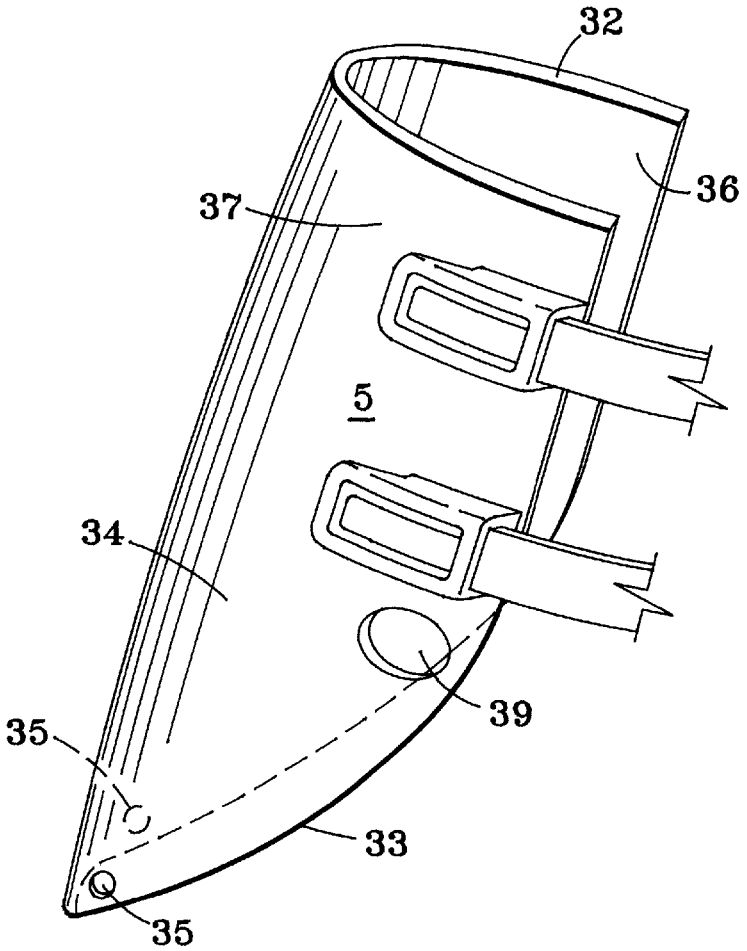
FIG. 13 is a perspective view of the flexible ski boot spoiler with ski boot closure means attached.

As per FIGS. 1, 2 and 13, the spoiler (5) has a spoiler upper end (32), a spoiler lower end (33), a spoiler mid-body (34), a spoiler ventral surface (36) and a spoiler dorsal surface (37). The spoiler further has, locatable at the spoiler lower end, a spoiler pivot hole (35) passing completely therethrough. When constructed into the completed ski boot, the spoiler pivot hole (35) will align with a hole (63) locatable on the rigid shell base rear (7). The spoiler pivot hole (35) corresponds to the journal (6') found in the Perrissoud et al. patent. The instant invention utilizes a spoiler pivot fastening means, the spoiler pivot fastening means passing through the spoiler pivot hole (35) and the hole (63) locatable on the rigid shell base rear to pivotally attach the spoiler to the rigid shell base. This configuration permits the spoiler (5) to pivot forwardly and rearwardly relative to the rigid shell base (2). In the preferred embodiment, the spoiler pivot fastening means is a pivot pin, though any means for attachment which would permit pivotal attachment of the spoiler to the rigid shell base would do equally well.

As per FIGS. 1, 2 and 13, the spoiler (5) has a pair of spoiler mid-body holes (39) passing therethrough. The spoiler mid-body holes (39) are oppositely aligned on the spoiler. In the preferred embodiment, the spoiler mid-body holes are each elliptical in form and are sized for the snug insertion thereinto each of a biasing means (40).

Figure 11:
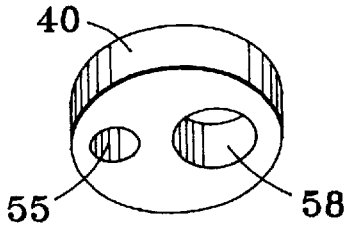
FIG. 11 is a perspective view of the flexible ski boot biasing means.

As per FIGS. 2 and 11, in the preferred embodiment the biasing means (40) is sized and shaped for snug insertion into the spoiler mid-body holes (39) and has biasing means thickness. The biasing means further has a biasing means first hole (55) passing completely therethrough. The biasing means also has a biasing means second hole (58) passing completely therethrough. The biasing means second hole, in the preferred embodiment, enables the biasing means to be compressed. Variations in the diameter of the biasing means second hole further varies the compressibility of the biasing means. Applicant believes that the larger the diameter of the biasing means second hole, the more the biasing means may be compressed. In the preferred embodiment, the biasing means is a di-rubber washer (or bi-rubber washer), though any biasing means which is somewhat compressible and which returns to its original shape when pressure is removed from it will do equally well. Applicant believes that in the event a biasing means having sufficient compressibility by virtue of the material used (for example, a material being inherently "spongy") is utilized, it would be unnecessary for the biasing means to have a biasing means second hole (58). When assembled into the completed ski boot, the biasing means first hole (55) is coaxial with the third horizontal axis (14), and the biasing means second hole (58) is parallel to the biasing means first hole. Furthermore, it should be understood that while a rubber washer is utilized in the preferred embodiment, any means which would allow the spoiler to pivot relative to the rigid shell base while at the same time tending to maintain the spoiler in its original upright position would do equally well.

Figure 12:
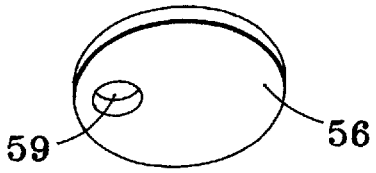
FIG. 12 is a perspective view of the flexible ski boot biasing means retainer.

The biasing means (40) is further retained snugly within the spoiler mid-body holes by a biasing means retainer (56). As per FIG. 12, the biasing means retainer is shaped similarly to the biasing means (40) and sized somewhat larger than the spoiler mid-body holes (39), such that the biasing means retainer does not fit within the spoiler mid-body holes. The biasing means retainer has a biasing means retainer hole (59) passing completely therethrough. Like the biasing means hole (55), the biasing means retainer hole is coaxial with the third horizontal axis (14) when the ski boot is completely assembled.

In the assembled ski boot, the biasing means retainer (56) is held snugly against the biasing means and the biasing means (40) is maintained within the spoiler mid-body holes (39), by a biasing means fastener which passes through the biasing means retainer, the biasing means first hole, the spoiler mid-body hole and a rigid shell base retainer hole (65) locatable on the rigid shell base (2), the rigid shell base retainer hole being coaxial with the biasing means first hole and the biasing means retainer hole. When the biasing means fastener it tightened snugly into the rigid shell base retainer hole, the rigid shell base is pulled into contact with the rear side of the biasing means, thereby further retaining the biasing means within the spoiler mid-body hole. The location of the spoiler mid-body hole and the rigid shell base retainer hole corresponds to the location in the prior art of the adjustable stud, also referred to as a "pivoting stud" in Baggio et al., U.S Pat. No. 4,928,498. In the preferred embodiment, the rigid shell base retainer hole is a tapped hole sized and shaped for insertion therethrough of a threaded insert. In the preferred embodiment, the biasing means fastener is a threaded bolt.

The complete operation of the instant invention may now be understood. A skier places his or her foot within the interior of the boot, tightens the ski boot closure means (64) and attaches the boot to the skis as per the commonly known ski boots. In the "at rest state" (where no rearward pressure is being applied against the spoiler/tongue), the tongue stop (52) and the cuff stop (50) are in direct contact with one another, preventing the upper section of the boot from flexing forwardly relative to the lower section of the boot. Once skiing, the skier may nearly fall. During this near fall, the skier's balance may shift rearwardly. As the skier's weight shifts rearwardly, the tongue section (4) and the spoiler section (5) tend to pivot in unison rearwardly, the pivoting occurring at the first pivot axis, coaxially with second horizontal axis (13) and at the second pivot axis. As the spoiler section and the tongue section incline rearwardly, the internal dimension of the upper section of the ski boot, as defined by the spoiler section and tongue section, remains constant due to the presence of the biasing means (40) which sets within both of the spoiler mid-body holes (39) and the closure means (64) which retain the tongue against the spoiler. The spoiler has ski boot closure means which wrap around and over the tongue section dorsal surface, thereby temporarily connecting the spoiler to the tongue section. The rearward force produced by the leg within the boot during the backward near fall is absorbed somewhat by the biasing means (40). It should be clear that because the biasing means fastener passes through the spoiler section and the rigid shell base, that the rearward force will compress the biasing means somewhat, permitting the tongue section and spoiler section to incline somewhat rearwardly relative to the rigid shell base. The presence of the biasing means retainer (56) prevents the biasing means from deforming outwardly, away from the boot, thereby further controlling the amount of pivoting which may take place.

As the upper section of the boot pivots rearwardly relative to the rigid shell base, the tongue section (4) and the cuff section (21) being flexibly connected to one another, flex relative to one another. By allowing the tongue section and the cuff section to flex relatively to one another, the instant invention makes it possible for the tongue section (4) and the spoiler section (5) to pivot forwardly and rearwardly relative to the rigid shell base and the cuff section, while at the same time maintaining a seal between the tongue section and the cuff section which prevents the unwanted intrusion of materials into the boot.

Furthermore, as the skier regains his or her balance, leaning forward, the cuff stop (50) and the tongue stop (52) come into contact with one another and prevent the upper section of the boot from pivoting too far forwardly.

It should now also be clear that by varying the compressibility of the biasing means, a skier may determine precisely how much rearward force will be tolerated before the upper section of the boot pivots rearwardly. This allows for custom configuration of the instant invention based upon the skier's desires and physical requirements. Furthermore, because the biasing means tends to regain its original uncompressed dimensions as force is removed, it should in fact provide a small degree of assistance reorienting the upper section of the ski boot to its at rest state, as it was prior to the application of rearward force.

Claims

I claim:

1. A flexible ski boot comprising;

A. a rigid shell base,

B. a cuff section,

I. the cuff section having a cuff front, a cuff rear, a cuff dorsal surface, a cuff ventral surface, a. the cuff dorsal surface having a cuff stop, i. the cuff stop having a hole passing completely therethrough, b. the cuff ventral surface having a cuff stop cavity, i. the cuff stop cavity being located on the cuff ventral surface, below the cuff stop, II. the cuff section having a cuff flexure yoke, a. the cuff flexure yoke having a cuff flexure yoke body, i. the cuff flexure yoke body having a cuff flexure yoke body hole passing completely therethrough, ii. the cuff flexure yoke having a pair of cuff flexure yoke lobes depending therefrom, aa. the cuff flexure yoke lobes each having a cuff flexure yoke hole passing completely therethrough, the cuff flexure yoke lobe holes being parallel to the cuff flexure yoke body hole, b. the cuff flexure yoke having a cylindrical cuff pin, the cylindrical cuff pin being sized to snugly pass through the cuff stop hole and the cuff flexure yoke body hole, thereby pivotally attaching the cuff flexure yoke to the cuff section, II. the cuff section having a pair of holes passing completely through the cuff dorsal surface and the cuff ventral surface, a. the cuff section holes being located proximate to the cuff rear, III. the cuff section having a cuff section retaining hole for fastening the cuff section to the rigid shell base, IV. the cuff section having cuff section retainer means, the cuff section retainer means passing through the cuff section retaining hole and the rigid shell base, thereby fixedly attaching the cuff section to the rigid shell base, C. a tongue section, I. the tongue section having a tongue section upper end, a tongue section mid-body, a tongue section lower end, a tongue section dorsal surface and a tongue section ventral surface, a. the tongue section lower end having depending therefrom a pair of tongue section lobes, i. the tongue section lobes each having a hole passing completely therethrough, II. the tongue section having a tongue stop, a. the tongue stop being located on the tongue section dorsal surface, proximate to a most forward edge of the tongue section lower end, III. the tongue section having a tongue section slot, a. the tongue section slot being located between the tongue section stop and the most forward edge of the tongue section lower end, b. the tongue section slot passing completely through the tongue section dorsal surface and the tongue section ventral surface, IV. the tongue section having a pair of tongue section lobes depending therefrom, a. the tongue section lobes each having a tongue section lobe hole passing completely therethrough, V. the tongue section having a tongue section pivot tang, a. the tongue section pivot tang extending downwardly from the tongue section ventral surface and forwardly, below the tongue section slot, i. the tongue section pivot tang having a tongue section pivot tang hole, the tongue section pivot tang hole passing completely therethrough, the tongue section pivot tang hole being parallel to the cuff flexure yoke lobe holes, b. the tongue section pivot tang having a cylindrical tang pin, the cylindrical tang pin passing through the cuff flexure yoke lobe holes and the tongue section pivot tang hole, thereby flexibly fastening the tongue section to the cuff section, VI. the tongue section having a pair of tongue and cuff pivot fastening means, the tongue and cuff pivot fastening means passing through the cuff hole, the tongue section lobe hole and a hole on the rigid shell base, thereby pivotally attaching the tongue section to the cuff section and the rigid shell base, VII. the tongue section having a cuff sealing means, a. the cuff sealing means being located between the tongue section slot and the most forward edge of the tongue section lower end, b. the cuff sealing means extending toward the tongue section lobe hole such that when assembled, the cuff sealing means prevents the intrusion of unwanted materials into the flexible boot, D. a spoiler section, I. the spoiler section having a spoiler upper end, a spoiler mid-body, a spoiler lower end, a spoiler dorsal surface and a spoiler ventral surface, a. the spoiler lower end having a spoiler pivot hole passing completely therethrough, II. the spoiler section having a spoiler pivot fastening means, the spoiler pivot fastening means passing through the spoiler pivot hole and a hole located on the rigid shell base rear, thereby pivotally attaching the spoiler section to the rigid shell base, III. the spoiler section having a pair of spoiler section mid-body holes, a. the spoiler section mid-body holes passing completely through the spoiler section dorsal surface and the spoiler section ventral surface, proximate to the spoiler section mid-body, IV. the spoiler section having ski boot closure means, the ski boot closure means wrapping around and over the tongue section dorsal surface, thereby temporarily connecting the spoiler to the tongue section, E. biasing means, I. the biasing means being sized and shaped to be snugly inserted within the spoiler section mid-body holes, II. the biasing means having a biasing means first hole, a. the biasing means first hole passing completely through the biasing means, III. the biasing means having a biasing means second hole, a. the biasing means second hole passing completely through the biasing means, parallel to the biasing means first hole, F. a biasing means retainer, I. the biasing means retainer being slightly larger than the spoiler section mid-body holes such that the biasing means retainer will not fit within the spoiler section mid-body holes, II. the biasing means retainer having a biasing means retainer hole, a. the biasing means retainer hole being sized and shaped similarly to the biasing means first hole, III. the biasing means retainer being snugly held against the biasing means by a biasing means fastener, a. the biasing means fastener passing through the biasing means retainer hole, b. the biasing means fastener passing through the biasing means first hole, c. the biasing means fastener being removably attached within a rigid shell base retainer hole.

2. The flexible ski boot according to claim 1, wherein the biasing means further comprises;

I. a compressible rubber washer, a. the compressible rubber washer having a thickness no greater than a thickness of the spoiler section.

3. The flexible ski boot according to claim 1, wherein the biasing means further comprises;

I. compressible rubber washer, a. the compressible rubber washer having a thickness greater than a thickness of the spoiler section.

4. The flexible ski boot according to claim 2, wherein the biasing means retainer further comprises;

I. a discoidal configuration.

* * * * *